US009462370B2

(12) United States Patent
Sato

(10) Patent No.: US 9,462,370 B2
(45) Date of Patent: Oct. 4, 2016

(54) MUTING DEVICE

(71) Applicant: KYUSHU INSTITUTE OF TECHNOLOGY, Kitakyushu (JP)

(72) Inventor: Yasushi Sato, Kitakyushu (JP)

(73) Assignee: KYUSHU INSTITUTE OF TECHNOLOGY, Kitakyushu-Shi, Fukuoka (JP)

( * ) Notice: Subject to any disclaimer, the term of this patent is extended or adjusted under 35 U.S.C. 154(b) by 155 days.

(21) Appl. No.: 14/372,965

(22) PCT Filed: Jan. 31, 2013

(86) PCT No.: PCT/JP2013/052223
§ 371 (c)(1),
(2) Date: Jul. 17, 2014

(87) PCT Pub. No.: WO2013/118636
PCT Pub. Date: Aug. 15, 2013

(65) Prior Publication Data

US 2015/0003624 A1 Jan. 1, 2015

(30) Foreign Application Priority Data

Feb. 8, 2012 (JP) ..... 2012-025449

(51) Int. Cl.
*H04R 1/10* (2006.01)
*G10K 11/178* (2006.01)
(Continued)

(52) U.S. Cl.
CPC ..... *H04R 1/1083* (2013.01); *G10K 11/178* (2013.01); *H04R 1/028* (2013.01);
(Continued)

(58) Field of Classification Search
CPC ..... G10K 11/178; G10K 2210/128; G10K 2210/3221; G10K 2210/3226; H04R 1/1083; H04R 3/002; H04R 3/005; H04R 1/028; H04R 2410/05; H04R 2217/03; H04R 2499/13; H04R 2460/01; H04R 5/023
USPC ..... 381/71.6, 71.11, 71.1, 71.2, 71.4, 71.7, 381/71.12, 92, 94.6, 96
See application file for complete search history.

(56) References Cited

U.S. PATENT DOCUMENTS 5,485,523 A 1/1996 Tamamura et al.
6,434,239 B1 * 8/2002 DeLuca ..... G10K 11/1788 381/71.1

(Continued)

FOREIGN PATENT DOCUMENTS

CN 1972525 A 5/2007
CN 101007522 A 8/2007

(Continued)

OTHER PUBLICATIONS

International Search Report (PCT/ISA/210) mailed on Apr. 9, 2013, by the Japanese Patent Office as the International Searching Authority for International Application No. PCT/JP2013/052223.

(Continued)

*Primary Examiner* — David Ton
(74) *Attorney, Agent, or Firm* — Buchanan Ingersoll & Rooney PC

(57) ABSTRACT

In order to enable noises entering the ear from random directions to be muted without wearing headphones, this muting device is provided with: a super-directional microphone that detects noises in spot areas around the ear at pinpoints; and an ultrasonic speaker that modulates and outputs a carrier signal supplied by a transmitter according to noise signals detected by the super-directional microphone. Furthermore, an adaptive filter is provided, and the adaptive filter supplies noise signals with the opposite phase to noises detected by the super-direction microphone, and transmits an ultrasonic signal from the ultrasonic speaker toward the eardrum of a human.

5 Claims, 7 Drawing Sheets

(51) Int. Cl.

| | |
|---|---|
| ***H04R 1/02*** | (2006.01) |
| ***H04R 3/02*** | (2006.01) |
| ***H04R 3/00*** | (2006.01) |
| *H04R 5/02* | (2006.01) |

(52) U.S. Cl.

CPC ..... *H04R 3/002* (2013.01); *H04R 3/005* (2013.01); *G10K 2210/128* (2013.01); *G10K 2210/3221* (2013.01); *G10K 2210/3226* (2013.01); *H04R 5/023* (2013.01); *H04R 2217/03* (2013.01); *H04R 2410/05* (2013.01); *H04R 2460/01* (2013.01); *H04R 2499/13* (2013.01)

(56) References Cited

U.S. PATENT DOCUMENTS

| | | | |
|---|---|---|---|
| 2007/0121968 | A1 | 5/2007 | Na |
| 2007/0127736 | A1 | 6/2007 | Christoph |
| 2010/0034398 | A1 | 2/2010 | Odent et al. |
| 2011/0095940 | A1 | 4/2011 | Breed |

FOREIGN PATENT DOCUMENTS

| | | | |
|---|---|---|---|
| CN | 101231846 | A | 7/2008 |
| CN | 101802905 | A | 8/2010 |
| CN | 201708909 | U | 1/2011 |
| JP | 06266375 | A | 9/1994 |
| JP | 06282279 | A | 10/1994 |
| JP | 2005-159731 | A | 6/2005 |
| JP | 2005-352255 | A | 12/2005 |
| JP | 2007-180922 | A | 7/2007 |
| WO | 2005004532 | A1 | 1/2005 |

OTHER PUBLICATIONS

Chinese Official Action, issued Dec. 17, 2015, by the Chinese Patent Office, in corresponding Chinese Patent Application No. 201380008817.7 with English language translation (16 pages).

European Search Report, issued Feb. 2, 2016, by the European Patent Office, in corresponding European Patent Application No. 13746519.1 (7 pages).

Yu Jingzhou, Li Shuangtian, Super-Directional Microphone Array Based on the End-tire Array, vol. 25. No. 8A (4 pages).

* cited by examiner

DETECT SOUND AROUND EAR BY SUPER-DIRECTIONAL MICROPHONE

MUTING DEVICE

TECHNICAL FIELD

The present invention relates to a muting device for canceling noises reaching the ear from various directions.

BACKGROUND ART

In order to cancel a noise reaching the ear from one direction, a method of creating and adding a control sound with a phase opposite to that of the reaching noise is generally employed. That is, it is a method of canceling the sound by using a wave nature of a sound. That is, even a noise is a sonic wave and thus has a predetermined phase. Therefore, by creating a sound with a phase opposite to that of the noise and adding the sound and the noise, the two sounds cancel each other and the sound is made smaller.

FIG. 1 is a diagram for illustrating a muting technology for muting a noise in a piping. Bidirectional noises are generated in a piping 101. The noises generated in this piping 101 propagate to a piping 102 to become a one-way noise, which propagates from a left side to a right side in FIG. 1. In order to remove such a noise in the piping 102, a microphone 103 for detecting a noise and a microphone 104 for detecting an error signal are provided in the piping 102.

Moreover, an LMS (Least Mean Square) adaptive filter 105 for inputting output signals from the microphone 103 and the microphone 104 is provided, and an amplifier 106 for amplifying an output of this LMS adaptive filter 105 and a muting speaker 107 for inputting an output of the amplifier 106 are arranged. The LMS adaptive filter 105 will be described later, but owing to development of the recent digital signal processing technology, an active muting device using the LMS adaptive filter has been widely used.

With the above described configuration, the noise propagating in the piping 102 is first detected by the microphone 103, and this signal is supplied to the LMS adaptive filter 105. On the other hand, an error signal that the microphone 104 outputs after detecting a muted sound is also supplied to the LMS adaptive filter 105. The LMS adaptive filter 105 is a filter functioning so that the error signal that the microphone 104 outputs after detecting the noise-canceled sound becomes as close to '0' as possible.

The output signal of the LMS adaptive filter 105 is reversed and amplified by the amplifier 106 and supplied to the muting speaker 107. Since the sonic wave outputted from the muting speaker 107 has become a sonic wave with a phase opposite to that of the sonic wave detected by the microphone 103, the noise propagating in the piping 102 is canceled. Therefore, the noise detected by the microphone 104 becomes as close to '0' as possible. Here, the distance between the microphone 103 and the speaker 107 needs to be arranged to be 30 cm or more apart from each other in order to ensure time for signal processing in the LMS adaptive filter 105. Moreover, the sound that can be muted by this method is only a noise propagating in one direction.

An example illustrated in FIG. 2 is an example in which the noise generated from a noise source 200 propagates from three directions including reflections from a floor and a ceiling. Here, the case in which, a reflection noise from a ceiling and a reflection noise from a floor are added in addition to the directly propagated noise, and the noises from three directions propagate in a space will be described. In the example in FIG. 2, too, a microphone 201 for detecting a noise and a microphone 202 for detecting an error signal are provided, and these detected signals are supplied to an LMS adaptive filter 203. Then, an output of the LMS adaptive filter 203 is inputted into an amplifier 204, reversed and amplified and then supplied to a speaker 205. Processing in the LMS adaptive filter 203 is the same as that in the LMS adaptive filter 105 in FIG. 1, and thus the explanation will be omitted.

The noise directly reaches the microphones 201 and 202 along a path of an arrow a from the noise source 200, and the noise is reflected by the ceiling and the floor to indirectly reach the microphone 202 along paths of arrows b and c. As is known form this figure, the distance from the noise source 200 to the microphone 202 is different between the path a and the paths b and c, and thus, a phase of the noise reached along the path a and phases of the noise reached along the paths b and c are different from each other. Therefore, a sonic wave outputted by the speaker 205 by functioning of the LMS adaptive filter into which a signal of the microphone 201 is inputted has a phase opposite to that of the noise detected by the microphone 201. Thus, the noise reached along the arrow a path is canceled, but the noises reached along the arrows b and c cannot be canceled, because the noises do not have the phase opposite to the phase of the sound of the speaker 205. Moreover, since the LMS adaptive filter does not function for the case where the noises are propagated from multiple directions such as other noise sources 200*a* and 200*b*, these noises cannot be canceled.

Such a situation is the same in an environment inside an automobile, and thus, it has been extremely difficult to completely remove the noise coming into the automobile.

On the other hand, a device for canceling a noise by generating a noise with a phase opposite to that of a noise applied to an earphone and by adding this opposite-phase signal to a signal from an earphone speaker by using a microphone for detecting a noise arranged around an ear has been proposed as a canceling headphone (see Patent Document 1, for example). In this method, a microphone for converting an ambient noise to an electric signal is provided in a headphone unit covering an ear of a user, and a phase of a noise detected by this microphone is reversed and added to a sound (signal+noise) coming into the ear of the user. As a result, only a sound from which a noise is removed propagates to the ear of the user, and a headphone which cancels an ambient noise (noise-cancels) is realized.

FIG. 3 illustrates an example of a canceling headphone. A microphone 301 for detecting a noise and a speaker (earphone) 302 are provided in a headphone to be worn on an ear, a noise signal detected by the microphone 301 for detecting a noise is converted by a reverse amplifier 303 to an opposite phase and then, supplied to the speaker 302.

Moreover, a noise removing device in which an environmental sound at a hearing position of an acoustic signal is collected by a microphone or the like, and a muting signal created from this environmental sound signal for muting a noise signal component is combined with an acoustic signal to mute the noise at the hearing position is proposed (see Patent Literature 2, for example). The technology described in this Patent Literature 2 is to create a muting signal from an environmental sound signal collected at a hearing position to modulate a carrier frequency with a composite acoustic signal obtained by combining this muting signal and an audible frequency signal (an audio signal, for example) and to supply the modulated signal to an ultrasonic speaker.

CITATION LIST

Patent Literature

PTL 1: Japanese Laid-Open No 2007-180922
PTL 2: Japanese Laid-Open No. 2005-352255

SUMMARY OF THE INVENTION

Technical Problem

However, in a canceling headphone illustrated in FIG. 3, since the distance between the microphone 301 for detecting a noise and an earphone speaker 302 is approximately 1 cm, so-called howling (unpleasant noise) in which the microphone 301 picks up a sound of the speaker 302 occurs. In order to eliminate this howling, a shielding plate 304 for preventing howling as illustrated in FIG. 3 is needed, but actually, since a skin of a human works as this shielding plate 304, the shielding plate 304 is not provided in the headphone itself to be worn.

FIG. 4 illustrates that a noise is removed by detecting the noise reaching around the ear and by reversing the phase thereof and supplying it to a speaker without providing a shielding plate for preventing howling. That is, the noise from a noise source 400 is detected by a microphone 401, and this signal is supplied to a speaker 403 around the ear via an LMS adaptive filter 402.

However, in this method, the headphone should be worn on the ear. On the other hand, the present invention is intended to provide an in-vehicle environment in which a VIP (Very Important Person) seated on a rear seat of a car (luxurious automobile) can relax without being annoyed by an ambient noise, for example. Therefore, it is impossible to make people seated on such rear seats wear the canceling headphone for sound muting.

Moreover, in the technology described in Patent Literature 2, a noise at a position where a sound is heard is picked up by a microphone, and a noise muting signal and an ultrasonic signal are superposed so as to remove the noise, but FFT (Fast Fourier Transform) calculation is used for a portion for creating a muting signal. Thus, there is a problem that a mechanism for muting a noise is complicated such that a frequency band of the noise to be muted should be selected by using a so-called SS method (Spectral Subtraction Method) for subtracting a frequency spectrum of the environmental noise stored in a buffer in advance.

The present invention has an object to provide a muting device for canceling and muting noises entering the ear from random directions as in a rear seat of an automobile with a simpler configuration in a non-contact manner without wearing a headphone.

Solution to Problem

In order to solve the above described problems, a muting device of the present invention includes a super-directional microphone that detects noises in spot areas around the ear at pinpoints; an adaptive filter that inputs a noise signal outputted by the super-directional microphone and outputs a signal with a phase opposite to that of the noise signal; and an ultrasonic speaker that modulates a carrier signal in an ultrasonic band outputted by an oscillator according to the signal of the adaptive filter to generate an ultrasonic wave toward the ear. When the ultrasonic wave generated by this ultrasonic speaker reaches an eardrum and demodulated by the eardrum to an audible sound, the demodulated audible sound has a phase opposite to that of the noise detected by the super-directional microphone.

Thus, the ultrasonic speaker used in the muting device of the present invention includes a modulator, and in this modulator, the carrier signal of the ultrasonic band is modulated with a signal having a phase opposite to that of the noise signal from the directional microphone. Then, a signal modulated by this modulator is applied to an actuator, and the modulated ultrasonic wave generated by the actuator is adapted to propagate to the eardrum of a human. The modulated ultrasonic wave reaches the eardrum, but the ultrasonic wave is not heard and only the demodulated sound is heard, and thus the noise reaching around the ear is muted.

Advantageous Effect of the Invention

The muting device of the present invention has an effect of decreasing a noise heard around the ear of a human being seated on a seat as much as possible when the muting device is installed in a headrest of a rear seat of an automobile, for example.

BRIEF DESCRIPTION OF THE DRAWINGS

FIG. 5(A) is a diagram illustrating that the ultrasonic wave is converted to an audible sound by an eardrum, FIG. 5(B) is a diagram illustrating directivity of the ultrasonic speaker, and FIG. 5(C) is a circuit configuration diagram for explaining the operation principle of the ultrasonic speaker.

DESCRIPTION OF EMBODIMENT

An embodiment of a muting device that can remove a noise in a non-contact manner according to the present invention will be described below by referring to the attached drawings.

First, an ultrasonic speaker and a super-directional microphone used in the embodiment of the present invention will be described.

<Ultrasonic Speaker>

Figure 5A:
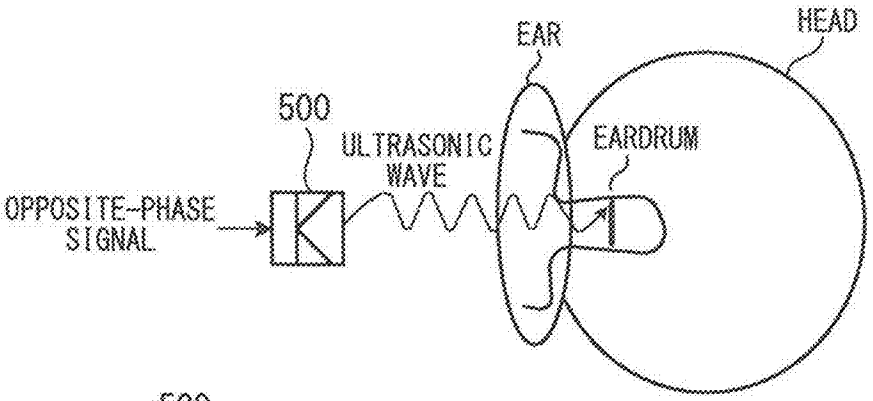
FIGS. 5A to 5C are diagrams illustrating an operation principle of an ultrasonic speaker used in an embodiment of the present invention.

FIG. 5(A) is a diagram illustrating that an ultrasonic wave emitted from an ultrasonic speaker 500 reaches an eardrum of an ear and is converted to an audible sound. By applying a signal with a phase opposite to that of a signal detected by a microphone to the ultrasonic speaker 500, the ultrasonic wave is FM-modulated and propagates to the eardrum, and the eardrum is vibrated with a noise and at the same time, is vibrated with a demodulated sonic wave. Since the two vibrations are in opposite phases, they are canceled and as a result, the noise is canceled and muted.

Figure 5B:
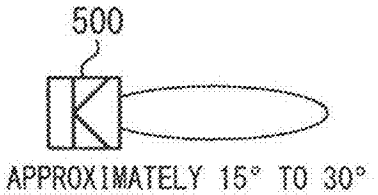
Figure 6:
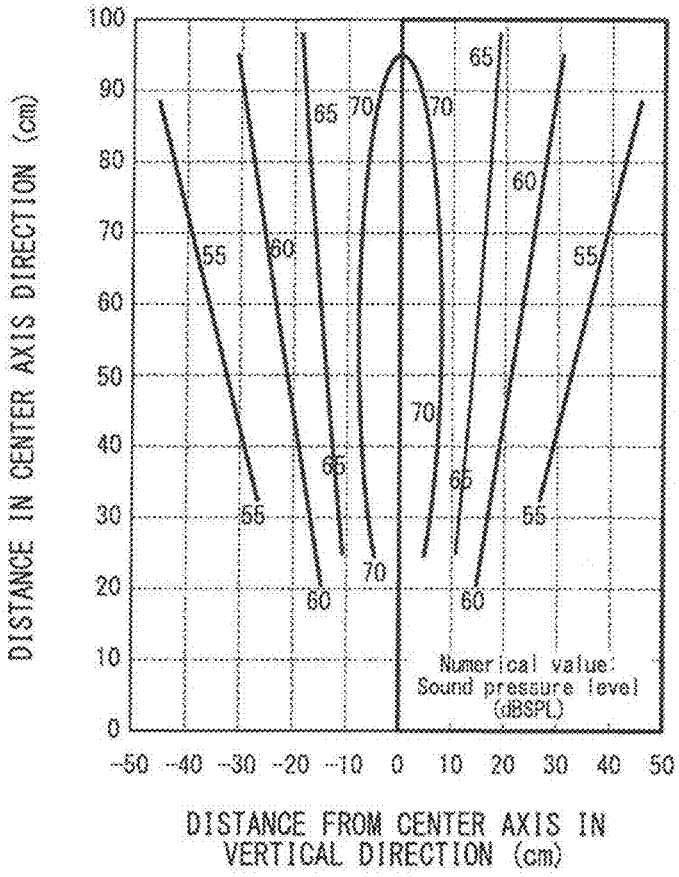
FIG. 6 is a simulation diagram illustrating a relationship between a distance from the ultrasonic speaker in a direction of a center axis and a sound pressure level in a direction perpendicular to the center axis.

FIG. 5(B) is a diagram schematically illustrating directivity of the ultrasonic speaker 500. As illustrated in FIG. 5(B), the directivity of the ultrasonic speaker 500 extends in an elliptic shape in a center axis direction with an extent of approximately 15 to 30° and thus, even if the ultrasonic speaker 500 is located somewhat away from the ear, the ultrasonic wave reaches the eardrum of the ear. FIG. 6 is a simulation diagram illustrating a distance from the ultrasonic speaker 500 in a direction of a center axis and a sound pressure level at a position in a direction perpendicular to the center axis. As is known from FIG. 6, the ultrasonic speaker 500 has strong directivity, and the sound propagates as far as a distance of approximately 90 cm with respect to the center axis direction. That is, if the ultrasonic speaker 500 is arranged at a position approximately 20 to 30 cm away from the ear, it is obvious that the ultrasonic wave reaches the eardrum of the ear.

That is, by using the ultrasonic speaker 500, even if it is arranged at a position somewhat away from the ear of a human, the ultrasonic wave generated there can be made to reach the eardrum of a human, and the ultrasonic wave can be converted by the eardrum to an audible sound. For example, assuming that the ultrasonic speaker 500 emits an ultrasonic wave at 50 kHz, if an ultrasonic wave oscillated at 51 kHz is added to this ultrasonic wave, it is converted by the eardrum to an audible sound of 1 kHz which is a difference between them. As described above, the eardrum has a function of modulating the ultrasonic wave as a non-linear element.

This ultrasonic speaker 500 has a size of a diameter of approximately 1 cm and has been already sold in the market by several companies. By arranging this ultrasonic speaker in a headrest of a rear seat of a car, the ultrasonic wave can be applied only to the ear of a person as a target of muting (a person who is seated on the rear seat). In the case of a driver, the driver would be in trouble if he/she cannot hear a sound from the environment, and thus, the ultrasonic speaker 500 is not arranged in the headrest of a driver's seat.

Figure 5C:
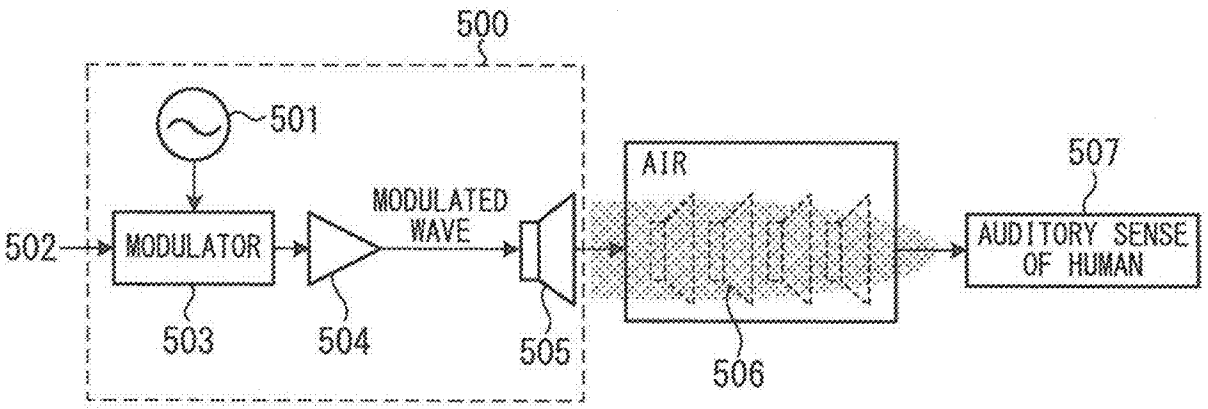

FIG. 5(C) is a diagram for explaining an operation principle when the eardrum is vibrated with a phase opposite to that of a noise by using the ultrasonic speaker 500. The ultrasonic speaker 500 includes a modulator 503 that modulates a carrier wave (at a frequency of 50 kHz) from a carrier signal oscillator 501 corresponding to a frequency of the ultrasonic wave with a signal (band of approximately 1 kHz) 502 having a phase opposite to that of a noise signal detected by a super-directional microphone which will be described later. A modulated signal modulated by the modulator 503 is supplied to an actuator (voice box) 505 via an amplifier 504. The modulated ultrasonic wave generated from the actuator 505 propagates to an auditory sense of a human (eardrum) 507 as a virtual sound source 506 and is converted to an audible sound at a band of approximately 1 kHz, here. Since a signal with a phase opposite to that of the noise is superposed on this audible sound, a sound wave from which the noise has been removed reaches the eardrum of a human.

<Super-Directional Microphone>

Figure 1:
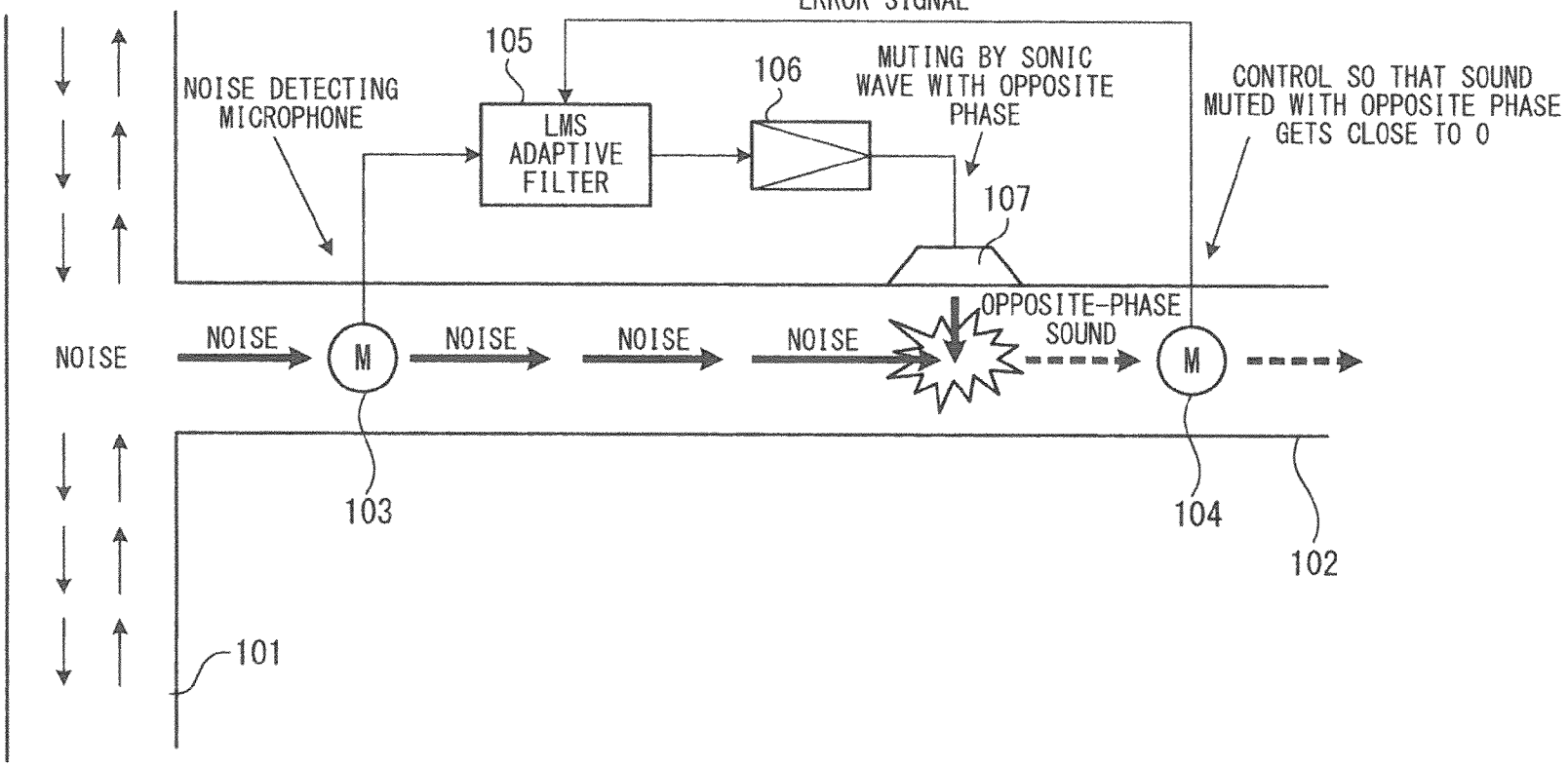
FIG. 1 is a diagram for explaining a prior-art technology for removing one-way noise.
Figure 2:
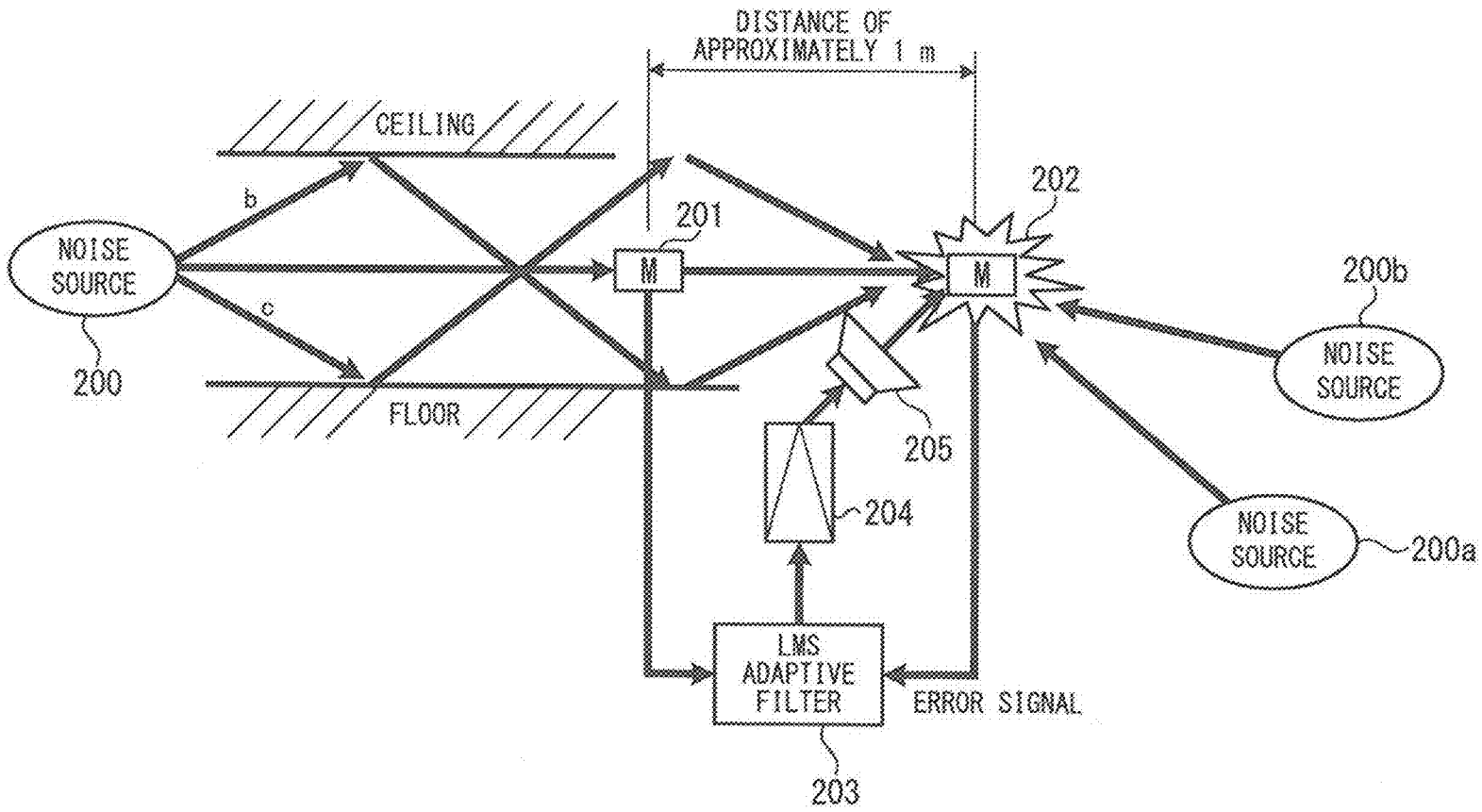
FIG. 2 is a diagram for explaining that noises from multiple directions cannot be sufficiently removed by the prior-art technology.
Figure 3:
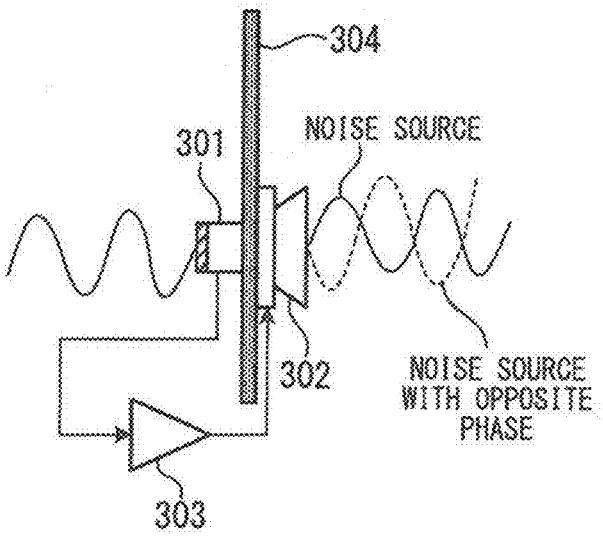
FIG. 3 is a diagram for explaining a technology for removing a noise around the ear by using a canceling headphone.
Figure 4:
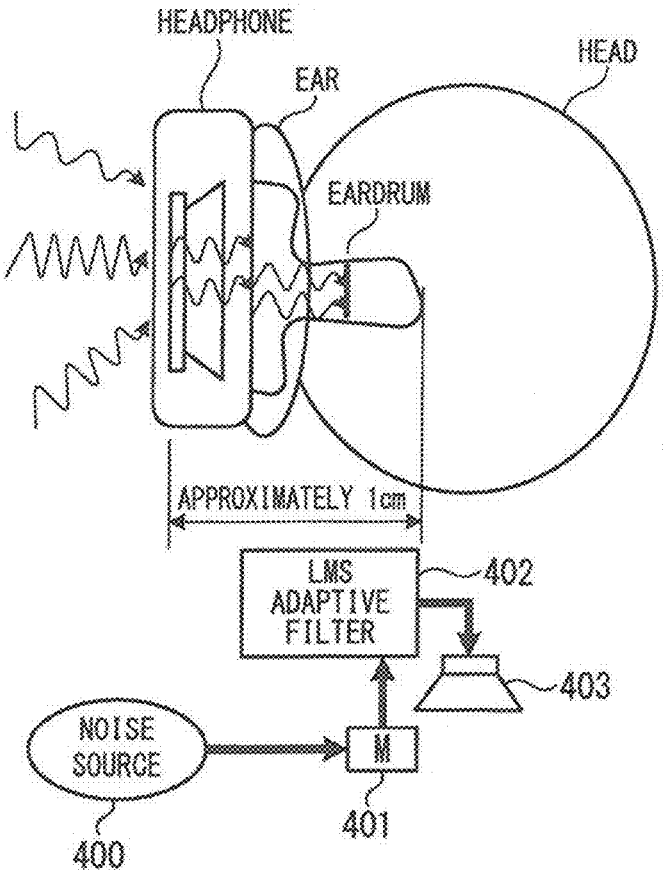
FIG. 4 is a diagram for explaining a problem of the technology for removing the noise by using the canceling headphone in FIG. 3.
Figure 7:
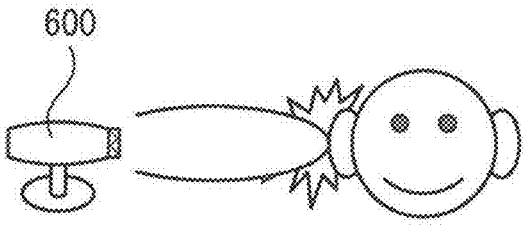
FIG. 7 is a diagram for explaining a super-directional microphone used in the embodiment of the present invention.

FIG. 7 is a diagram schematically illustrating a super-directional microphone 600 used in the embodiment of the present invention and its directivity characteristic, and it illustrates that, by using such a super-directional microphone 600, a noise around the ear can be detected even at a far-away position around the ear. If a normal microphone is used instead of the super-directional microphone 600, the sound at a spot where the microphone is placed can be detected, but detection of a sound at a target spot (around the ear, for example) located slightly away therefrom becomes difficult. Moreover, as explained in FIG. 2, it is also difficult to detect noises coming from multiple directions. Since this super-directional microphone 600 is also sold in a market in various types similarly to the ultrasonic speaker 500, one of them can be selected as appropriate.

A frequency that can be picked up by this super-directional microphone 600 is an audible sound at 20 kHz or less, and an ultrasonic wave exceeding 20 kHz cannot be detected. Therefore, even if the ultrasonic speaker 500 is arranged at a position close to the super-directional microphone 600, the ultrasonic wave emitted by the ultrasonic speaker 500 is not detected. That is, even if the ultrasonic speaker 500 and the super-directional microphone 600 are arranged close to each other in the headrest of the rear seat, the super-directional microphone 600 is not influenced by a sound emitted by the ultrasonic speaker 500, and thus, howling does not occur. Actually, processing time in an LMS adaptive filter 700 (see FIG. 8) which will be described later needs to be ensured, the ultrasonic speaker 500 and the super-directional microphone 600 are arranged with a distance of approximately 20 cm in the headrest.

<Embodiment>

Figure 8:
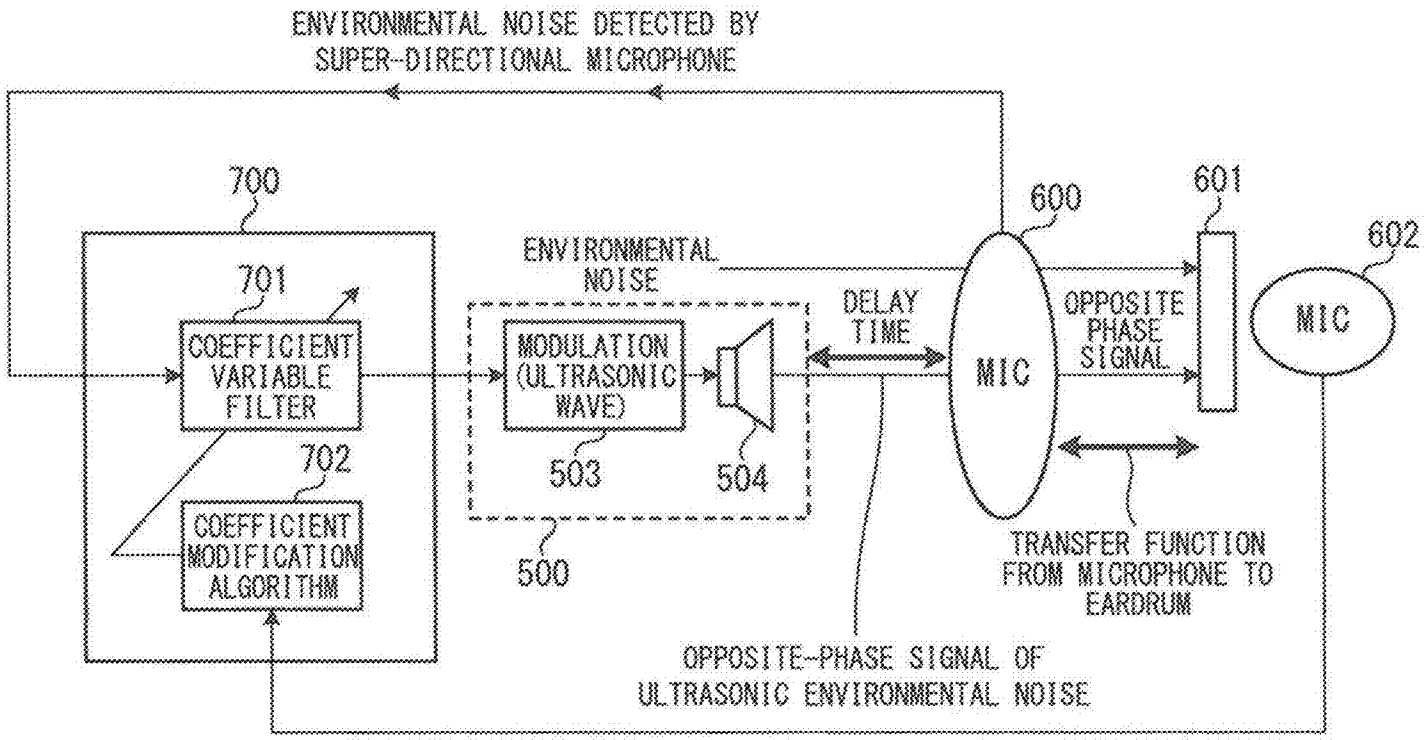
FIG. 8 is a block diagram illustrating a configuration of the embodiment of the present invention.

FIG. 8 illustrates the embodiment of the present invention, and first, an operation of the LMS adaptive filter 700 will be described. In the embodiment of the present invention, the super-directional microphone 600 and the ultrasonic speaker 500 including the modulator 503 and the actuator 504 are arranged at positions a predetermined distance (approximately 20 cm) away from an eardrum 601. Moreover, a non-linear microphone 602 is provided in the vicinity of the eardrum 601. This non-linear microphone 602 is used only once when coefficient adjustment of the LMS adaptive filter 700 is made, and if it is to be actually operated after the coefficient adjustment, this coefficient does not have to be updated, and this non-linear microphone 602 is not used.

Here, by using the LMS adaptive filter 700, a muting signal can be created with a simple configuration. That is, a buffer is not needed or processing with a large calculation amount such as FFT (Fast Fourier Transform) does not have to be made.

Subsequently, the coefficient adjustment of the LMS adaptive filter 700 will be described. A noise around the ear is converted into an electric signal by the super-directional microphone 600, and the converted signal is inputted into a coefficient variable filter 701 of the LMS adaptive filter 700.

The noise around the ear is converted into the electric signal also by the non-linear microphone 602, and when the converted signal is inputted into the LMS adaptive filter 700, it is subjected to arithmetic processing by a coefficient modification algorithm 702 and as a result, a coefficient of the coefficient variable filter is modified. This coefficient modification algorithm 702 modifies the coefficient of the coefficient variable filter 701 by working so that the signal of the non-linear microphone 602 gets closer to zero.

Here, a frequency characteristic of the non-linear microphone 602 is the same as that of the super-directional microphone 600. However, the non-linear microphone 602 has linearity poorer than the super-directional microphone 600 and larger distortion. The reason why this non-linear microphone 602 is used is that the non-linear microphone 602 has a non-linear characteristic similar to that of the eardrum. That is, when this non-linear microphone 602 receives an ultrasonic wave, the ultrasonic wave is demodulated also by the non-linear microphone 602 similarly to the eardrum 601 due to its non-linear characteristic and is converted into a sound in an audible band. As described above, the non-linear microphone 602 is arranged in the vicinity of the eardrum in order to serve as the actual eardrum 601. This non-linear microphone 602 can simulate the ultrasonic sound actually converted by the human ear into an audible band. By feeding back a muting error by this non-linear microphone 602, a muting state can be kept at the optimal all the time.

The environmental noise detected by the super-directional microphone 600 is sent to the modulator 503 of the ultrasonic speaker 500 as an output of the LMS adaptive filter 700 and modulated by the modulator 503 with an ultrasonic frequency of approximately 50 kHz. The sound wave generated from the actuator 504 of this ultrasonic speaker 500 becomes a muting sound with a phase opposite to that of the environmental noise. The coefficient of the LMS adaptive filter 700 is updated so that a transfer function from the super-directional microphone 600 to the eardrum 601 is learned. That is, the coefficient of the LMS adaptive filter 700 is set so as to be an inverse function of the transfer function of an acoustic propagation system between the super-directional microphone 600 and the eardrum 601.

As described above, in the embodiment of the present invention, a signal with a phase opposite to that of the noise detected by the super-directional microphone 600 is created by using the LMS adaptive filter 700, but after the coefficient has been already set, the coefficient is not updated and thus, the LMS adaptive filter 700 operates as a general FIR (Finite Impulse Response) filter.

In this embodiment, an algorithm (LMS algorithm) as the LMS adaptive filter is used, but the LMS algorithm also includes a Complex LMS Algorithm (Complex Least Mean Square Algorithm) and an NLMS Algorithm (Normalized Least Mean Square Algorithm) which are its variations.

Moreover, other than the LMS algorithm, similar processing can be performed by a projection algorithm, a SHARF (Simple Hyperstable Adaptive Recursive Filter) algorithm, an RLS (Recursive Least Square) algorithm, an FLMS (Fast Least Mean Square) algorithm, an adaptive filter using DCT (Discrete Cosine Transform), a SAN (Single Frequency Adaptive Notch) filter, a neural network, and other adaptive type filters such as a genetic algorithm.

Figure 9:
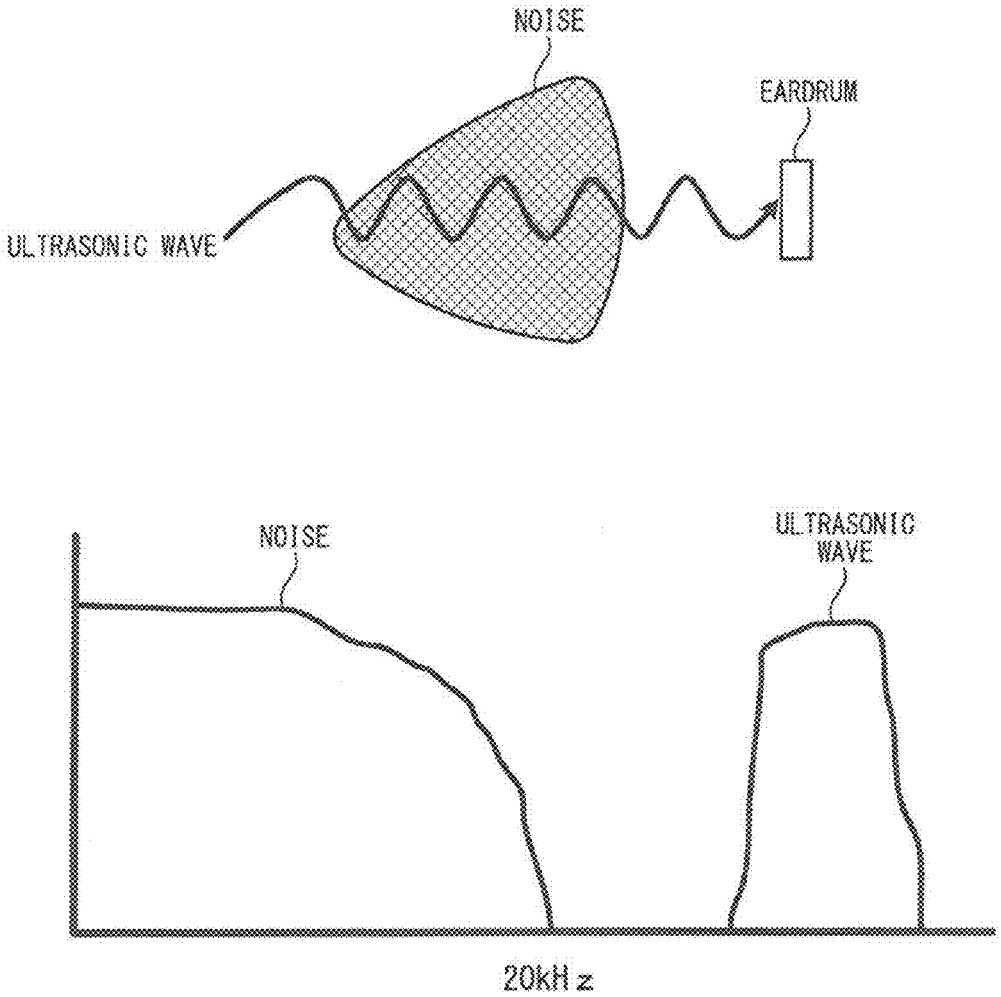
FIG. 9 is a diagram for explaining that an ultrasonic wave and an audible sound are separated by the eardrum.

FIG. 9 is a diagram for explaining that the ultrasonic wave and the audible sound have different frequency bands and thus, even if an ultrasonic wave is emitted toward the noise source, interference does not occur.

As illustrated in FIG. 9, since the environmental noise and the ultrasonic wave have different frequency bands, the ultrasonic wave generated from the ultrasonic speaker 500 in FIG. 8 and modulated with a signal having a phase opposite to that of the environmental noise, is demodulated to a sound with a phase opposite to that of the environmental sound upon reaching the eardrum 601. On the other hand, as illustrated in FIG. 8, since the environmental noise (in-phase signal) also reaches the eardrum 601, the sound with the phase opposite to that of the environmental sound is also applied to the eardrum 601 at the same time, and as a result, it is canceled and muted.

Moreover, as illustrated in FIG. 8, in a positional relationship between the environmental noise entering the super-directional microphone 600 and the ultrasonic speaker 500 generating a sound with a phase opposite to that of this environmental noise, since the ultrasonic speaker 500 is located farther (rear) than the super-directional microphone 600 with respect to the eardrum 601, the sound of the ultrasonic speaker 500 is slightly delayed by a portion of the distance between them. Thus, it is difficult to mute the environmental noise across all the frequencies, and particularly, a muting effect of a high sound deteriorates. However, since a high sound can be absorbed by a sound absorbing material and the like (not shown) in general, even the muting effect for a sound with a relatively low frequency can be a sufficient muting effect which can be offered for practical use.

The operation principle and the embodiment of the present invention are explained on the non-contact muting device in which the ultrasonic speaker and the super-directional microphone are arranged in the headrest of the rear seat in an automobile, but the present invention is applied not only to the rear seat of the automobile but can be also applied to a seat of a vehicle other than the automobile or a seat in a train, an aircraft or a ship, for example. Moreover, it is needless to say that the present invention is not limited to the above described embodiment but the present invention includes various variations and applications within a range not departing from a range described in the appended claims.

REFERENCE SIGNS LIST

103, 104, 201, 202, 301, 401 microphone
105, 203, 402, 700 LMS adaptive filter
106, 204 amplifier
107, 205, 302, 403 muting speaker
200, 200*a*, 200*b*, 400 noise source
500 ultrasonic speaker
503 modulator
504 amplifier
600 super-directional microphone
601 eardrum
602 non-linear microphone
701 coefficient variable filter
702 coefficient modification algorithm

The invention claimed is:

1. A muting device comprising:

a super-directional microphone configured to detect an environmental noise and output a noise signal of the detected environmental noise;

an adaptive filter configured to input the noise signal outputted by the super-directional microphone and output a signal with a phase opposite to that of the noise signal; and an ultrasonic speaker configured to modulate a carrier wave signal in an ultrasonic band with the signal with the phase opposite to that of the noise signal, outputted by the adaptive filter, and generate a modulated ultrasonic wave which can be demodulated by an eardrum, when reaching the eardrum, to an audible sound, the demodulated audible sound having the phase opposite to that of the environmental noise detected by the super-directional microphone, whereby a sound wave from which the detected environmental noise has been removed reaches the eardrum.

2. The muting device according to claim 1, wherein the ultrasonic speaker includes:

a modulator configured to modulate the carrier wave signal in an ultrasonic band with the signal with the phase opposite to that of the noise signal, outputted by the adaptive filter; and an actuator configured to input the modulated carrier wave signal and generate the modulated ultrasonic wave.

3. The muting device according to claim 1, further comprising:

a non-linear microphone to be placed in a vicinity of the eardrum, wherein the adaptive filter is a Least Mean Square (LMS) adaptive filter including a coefficient variable filter and a coefficient modification algorithm, and wherein the adaptive filter is configured to input a signal of the non-linear microphone and modify a coefficient of the coefficient variable filter in accordance with a calculation result of the coefficient modification algorithm so that the signal of the non-linear microphone gets closer to zero.

4. The muting device according to claim 3, wherein the coefficient of the coefficient variable filter of the LMS adaptive filter is set so that a transfer function of the LMS adaptive filter becomes an inverse function of a transfer function of an acoustic propagation system between the super-directional microphone and the eardrum.

5. The muting device according to claim 1, wherein the super-directional microphone is configured to pick up an audible sound at 20 kHz or less.

* * * * *